US012359514B2

(12) United States Patent
Gustafson et al.

(10) Patent No.: US 12,359,514 B2
(45) Date of Patent: Jul. 15, 2025

(54) SYSTEMS AND METHODS FOR MAKE-UP AND BREAK-OUT OF DRILL PIPE

(71) Applicant: Helmerich & Payne, Inc., Tulsa, OK (US)

(72) Inventors: Patrick L. Gustafson, Owasso, OK (US); Rick E. Barrett, Owasso, OK (US); Trevor Hall, Tulsa, OK (US); Christopher Alan Major, Tulsa, OK (US); Zachary L. Newton, Collinsville, OK (US); Andrew Rose, Tulsa, OK (US); William Chase Stogner, Tulsa, OK (US); Brandon D Valentine, Bixby, OK (US); Todd Ryan Woods, Perry, OK (US)

(73) Assignee: Helmerich & Payne, Inc., Tulsa, OK (US)

( * ) Notice: Subject to any disclaimer, the term of this patent is extended or adjusted under 35 U.S.C. 154(b) by 0 days.

(21) Appl. No.: 18/592,353

(22) Filed: Feb. 29, 2024

(65) Prior Publication Data

US 2024/0301757 A1 Sep. 12, 2024

Related U.S. Application Data

(60) Provisional application No. 63/491,888, filed on Mar. 23, 2023, provisional application No. 63/488,705, filed on Mar. 6, 2023.

(51) Int. Cl.
*E21B 19/10* (2006.01)
*E21B 3/02* (2006.01)
(Continued)

(52) U.S. Cl.
CPC ..... *E21B 19/10* (2013.01); *E21B 3/022* (2020.05); *E21B 19/06* (2013.01); *E21B 19/165* (2013.01); *E21B 19/18* (2013.01); *E21B 34/02* (2013.01)

(58) Field of Classification Search
CPC ..... E21B 19/00; E21B 19/10; E21B 19/06; E21B 19/07; E21B 19/18; E21B 19/165; E21B 34/02; E21B 3/022; E21B 3/045
See application file for complete search history.

(56) References Cited

U.S. PATENT DOCUMENTS 3,961,399 A * 6/1976 Boyadjieff ..... E21B 19/168 188/67
2013/0345878 A1 12/2013 Austefjord et al.
(Continued)

FOREIGN PATENT DOCUMENTS

WO 2014066368 A2 5/2014
WO 2016204608 A1 12/2016

OTHER PUBLICATIONS

PCT/US2024/017935, "International Search Report and Written Opinion", Jul. 10, 2024, 13 pages.

*Primary Examiner* — Nicole Coy
*Assistant Examiner* — Nicholas D Wlodarski
(74) *Attorney, Agent, or Firm* — Kilpatrick Townsend & Stockton LLP

(57) ABSTRACT

A method for connecting drill pipe to a drillstring in a wellbore includes positioning a lower section of drill pipe within a rotary slips and setting the rotary slips. The method includes positioning an upper section of drill pipe over a lower section of drill pipe and signaling an iron roughneck to extend toward a joint of the lower section of drill pipe and upper section of drill pipe. The method includes raising the iron roughneck to a height such that opposing tongs are positioned above and below the joint between the upper
(Continued)

section of drill pipe and the lower section of drill pipe, spinning the upper section of drill pipe into the lower section of drill pipe, clamping onto the lower section of drill pipe with the tongs of the iron roughneck, and spinning the upper section of drill pipe into the lower section of drill pipe.

17 Claims, 11 Drawing Sheets

(51) Int. Cl.

| | |
|---|---|
| ***E21B 19/06*** | (2006.01) |
| ***E21B 19/16*** | (2006.01) |
| ***E21B 19/18*** | (2006.01) |
| ***E21B 34/02*** | (2006.01) |

(56) References Cited

U.S. PATENT DOCUMENTS

| | | | | |
|---|---|---|---|---|
| 2021/0002995 | A1* | 1/2021 | Botnan | E21B 47/117 |
| 2021/0054701 | A1* | 2/2021 | Holck | E21B 44/10 |
| 2021/0115776 | A1* | 4/2021 | Gundersen | E21B 41/00 |
| 2021/0246739 | A1* | 8/2021 | Alshaarawi | E21B 19/161 |
| 2022/0145704 | A1* | 5/2022 | McKenzie | E21B 19/16 |
| 2022/0290513 | A1 | 9/2022 | Zheng | |

* cited by examiner

SYSTEMS AND METHODS FOR MAKE-UP AND BREAK-OUT OF DRILL PIPE

CROSS-REFERENCE TO RELATED APPLICATIONS

This application claims the benefit of priority to U.S. Provisional Patent Application No. 63/491,888, filed Mar. 23, 2023, and entitled "Systems and Methods for Make-Up and Break-Out of Drill Pipe," the contents of which are hereby incorporated by reference in their entirety for all purposes. The present application also claims the benefit of priority to U.S. Provisional Patent Application No. 63/488,705 filed Mar. 6, 2023, entitled "Method and Apparatus for Moving Tubular Rotary Slips," the contents of which are incorporated herein by reference in their entirety for all purposes.

This application is related to the commonly assigned and concurrently filed patent applications, the disclosure which are incorporated herein by reference in its entirety for all purposes: U.S. patent application Ser. No. 18/592,060, filed on Feb. 29, 2024, entitled "Method and Apparatus for Moving Tubular Rotary Slips," which claims the benefit of priority to U.S. Provisional Patent Application Ser. No. 63/488,705, filed on Mar. 6, 2023, and entitled "Method and Apparatus for Moving Tubular Rotary Slips."

BACKGROUND

In the oil and gas industry, extraction of hydrocarbon natural resources is done by physically drilling a hole to a reservoir where the hydrocarbon natural resources are trapped. The hydrocarbon natural resources can be up to 10,000 feet or more below the ground surface and be in and/or under various layers of geological formations. To run the drillstring downhole, tools such as rotary slips, torque wrenches, and iron roughnecks may aid in coupling joints of drill pipe (or tubulars) together as the drill pipe is being run into the wellbore. The tools may also aid in breaking out the drill pipe when the drillstring is removed from the wellbore. Rotary slips may be mountable in a rotary table for gripping and releasing a drill pipe being run down hole into and/or being pulled out of a well. Iron roughnecks may be used to couple joints of drill pipe together as the drill pipe is run into the wellbore or to decouple joints of drill pipe as the drill pipe is removed from the wellbore. Iron roughnecks may apply a torque to a length of drill pipe using tongs while another length of drill pipe is threaded onto an end of the first length. The spinners of the iron roughneck may turn a length of drill pipe to thread it onto a lower drill pipe while the lower drill pipe is held in place with the torque wrench/tongs. At times, the rotary slips may secure and hold onto a part of the drill pipe while an additional drill pipe is added to or removed from the pipe secured by the rotary slips.

The rotary slips may be automated, in whole or in part, such as disclosed and described in U.S. patent application Ser. No. 18/592,060 filed on Feb. 29, 2024, and entitled "Method and Apparatus for Moving Tubular Rotary Slips," which claims the benefit and priority of U.S. Provisional Patent Application Ser. No. 63/488,705, filed on Mar. 6, 2023, and entitled "Method and Apparatus for Moving Tubular Rotary Slips.". The iron roughneck may be one like that described and disclosed in U.S. Published Patent Application No. 2020/0277826 A1, published on Sep. 3, 2020, and entitled "Floor Wrench for a Drilling Rig," which is hereby incorporated by reference as if fully set forth herein.

SUMMARY OF THE INVENTION

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to one embodiment, a method for connecting drill pipe to a drillstring in a wellbore includes positioning a lower section of drill pipe within a rotary slips and setting the rotary slips. The method further includes positioning an upper section of drill pipe over a lower section of drill pipe and signaling, by an iron roughneck control system, an iron roughneck to extend toward a joint of the lower section of drill pipe and upper section of drill pipe. The method includes raising, via a control system interface, the iron roughneck to a height such that opposing tongs are positioned above and below the joint between the upper section of drill pipe and the lower section of drill pipe, clamping onto the upper section of drill pipe with spinners of the iron roughneck, spinning the upper section of drill pipe into the lower section of drill pipe, clamping onto the lower section of drill pipe with the tongs of the iron roughneck, and spinning the upper section of drill pipe into the lower section of drill pipe up to a predetermined torque value. In response to reaching the predetermined torque value, the method includes releasing, by the iron roughneck, the upper section of drill pipe and the lower section of drill pipe from the spinners and the opposing tongs. The method includes retracting the iron roughneck from a first position proximate a well center to a second position set by the iron roughneck control system, picking up a drillstring including the upper section of drill pipe and the lower section of drill pipe, retracting the rotary slips from the lower section of drill pipe of the drillstring, lowering a lower section of drillstring and a portion of an upper section of drillstring into the wellbore, reducing the lowering speed of the drillstring, signaling an apparatus for moving rotary slips to insert the rotary slips into a bowl of a rig floor, and transferring the drillstring to the rotary slips.

The method may include various optional embodiments. The method may further include connecting elevators to the drillstring prior to lowering the drillstring into the wellbore and moving a traveling assembly coupled to the elevators toward the drillstring. The method further includes disconnecting the elevators from the drillstring after lowering the drillstring into the wellbore and moving the traveling assembly up and away from the drillstring. Picking up the drillstring including the upper section of drill pipe and the lower section of drill pipe may further include picking up the drillstring including the upper section of drill pipe and the lower section of drill pipe with the traveling assembly and drawworks. Picking up the drillstring including the upper section of drill pipe and the lower section of drill pipe may further include picking up a full weight of the drillstring. The full weight of the drillstring may transferred to the rotary slips. A male end of the upper section of drill pipe may be positioned over and spun into a female end of the lower section of drill pipe. The apparatus for moving rotary slips may further include a movable base adapted to move between a first position and a second position, wherein the first position is closer to the bowl in the rig floor than the second position and a lifting arm having a first end and a second end, wherein the second end is pivotally coupled to the movable base, and wherein the lifting arm has a first arm position and second arm position. Inserting the rotary slips into the bowl of the rig floor further may further include moving the lifting arm to a first arm position, wherein moving the lifting arm to a first arm position comprises lowering at least the first end of the lifting arm, thereby placing at least a portion of the rotary slips in the bowl and moving the movable base to the first position, wherein a portion of the movable base is proximal the bowl in the first position.

According to one embodiment, a method for drilling a wellbore includes providing, by an apparatus for moving rotary slips, rotary slips in a retracted position out of a bowl of a rig floor, providing an iron roughneck in a retracted position away from a drillstring extending into a wellbore, providing the drillstring coupled to a top drive via a threaded connection; providing an elevator disconnected from an end of the drillstring and raising the drillstring to a height such that a tool joint between a first pipe and a second pipe of the drillstring is in a workable position above the rig floor. The method further includes setting a drillstring rotation to 0 and ramp corresponding drilling fluid pumps to a flowrate of 0. In response to the drillstring stopping rotation, the method includes signaling the apparatus for moving rotary slips to insert the rotary slips into the bowl in the rig floor, lowering the drillstring until a weight of the drillstring is transferred to the rotary slips, and signaling, via a rig control system interface, a top drive to break-out of the drillstring. In response to the top drive decoupling from the drillstring, the method includes raising a traveling assembly up to receive an additional section of drill pipe, latching elevators around the additional section of drill pipe, positioning a bottom end of the additional section of drill pipe over the drillstring, and lowering the additional section of drill pipe to contact a stump of the drillstring. The method includes positioning the iron roughneck, in response to a signal from an iron roughneck control system interface, proximate to a joint between the additional section of drill pipe and the stump of the drillstring, positioning a first pair of tongs above the joint and a second pair of tongs below the joint, clamping, by spinners of the iron roughneck, onto the additional section of drill pipe and spinning, by the iron roughneck, the additional section of drill pipe such that the additional section of drill pipe threads onto the stump of the drillstring such that the additional section of drill pipe and the drillstring couple together and an end of the additional section of drill pipe then defines the stump of the drillstring. The method further includes ceasing, by the iron roughneck, spinning the additional section of drill pipe in response to reaching a predetermined torque value, releasing, by the spinners and the tongs of the iron roughneck, the additional section of drill pipe and the drill pipe previously defining the stump, initiating a top drive makeup sequence to makeup the additional section of drill pipe to the top drive, and retracting the iron roughneck from the wellbore. The method includes picking up the drillstring with the traveling assembly and drawworks, signaling the apparatus for moving rotary slips to retract the rotary slips to a fully retracted position in which the rotary slips are retracted from the bowl, and with the rotary slips retracted from the bowl, turning on the rotary and lowering the drillstring into the wellbore.

The method may include various optional embodiments. The method may further include prior to lowering the drillstring, opening a bleed off valve of a drilling fluid supply line to bleed off any pressure remaining in the drilling fluid supply line, closing the bleed off valve, and closing an integrated blow out preventor (IBOP) valve. The method may further include, in response to the top drive being made-up to the additional section of drill pipe, closing the IBOP valve and increasing a pump flow rate. Lowering the additional section of drill pipe to contact the stump of the drillstring may further include that a male end of the additional section of drill pipe extending into a female end of a drill pipe defining the stump of the drillstring. The apparatus for moving rotary slips may include a movable base adapted to move between a first position and a second position where the first position is closer to the bowl in the rig floor than the second position and a lifting arm having a first end and a second end where the second end is pivotally coupled to the movable base and where the lifting arm has a first arm position and second arm position. Inserting the rotary slips into the bowl of the rig floor may further include moving the lifting arm to a first arm position where moving the lifting arm to a first arm position comprises lowering at least the first end of the lifting arm, thereby placing at least a portion of the rotary slips in the bowl. The method may include moving the movable base to the first position where a portion of the movable base is proximal the bowl in the first position. Retracting the rotary the rotary slips from the bowl of the rig floor may further include moving the lifting arm to a second arm position where moving the lifting arm to a second arm position includes raising at least the first end of the arm, thereby retracting the rotary slips from the bowl and moving the base to a second position where a portion of the base is moved away the bowl in the second position as compared to the first position.

According to yet another embodiment, a method of disconnecting pipe includes positioning a drillstring so that a portion of a pipe extends upwardly from a drilling rig floor and a pipe joint is positioned proximal to an iron roughneck, ceasing rotation of the drillstring, inserting a rotary slips into a bowl of the rig floor, transferring weight of the drillstring to the rotary slips, extending the iron roughneck toward the drillstring, and adjusting a height of the iron roughneck so that upper and lower tongs of the iron roughneck are located above and below, respectively, the pipe joint. The method includes clamping the lower tongs of the iron roughneck onto the drillstring below the pipe joint, clamping spinners of the iron roughneck onto the drillstring above the pipe joint, spinning a section of pipe forming the drillstring above the pipe joint relative to the remaining drillstring below the pipe joint by the iron roughneck to thereby unscrew the section of pipe from the drillstring, disengaging the iron roughneck from the section of pipe and the drillstring, and moving the section of pipe to a storage location.

The method may include various optional embodiments. Some or all of the steps may be performed automatically by a control system. Some or all of the steps may be repeated a plurality of times for a plurality of pieces of pipe. Inserting the rotary slips into the bowl of the rig floor may be performed by an apparatus for moving rotary slips. The apparatus for moving rotary slips may include a movable base adapted to move between a first position and a second position where the first position is closer to the bowl in the rig floor than the second position and a lifting arm having a first end and a second end where the second end is pivotally coupled to the movable base, and wherein the lifting arm has a first arm position and second arm position.

DESCRIPTION OF THE DRAWINGS

A further understanding of the nature and advantages of various embodiments may be realized by reference to the following figures. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label. The figures are not necessarily drawn to scale, and in some instances the drawings have been exaggerated and/or simplified in places for illustrative purposes only. One of ordinary skill in the art will appreciate the many possible applications and variations based on the following examples of possible embodiments.

DETAILED DESCRIPTION

Figure 1A:
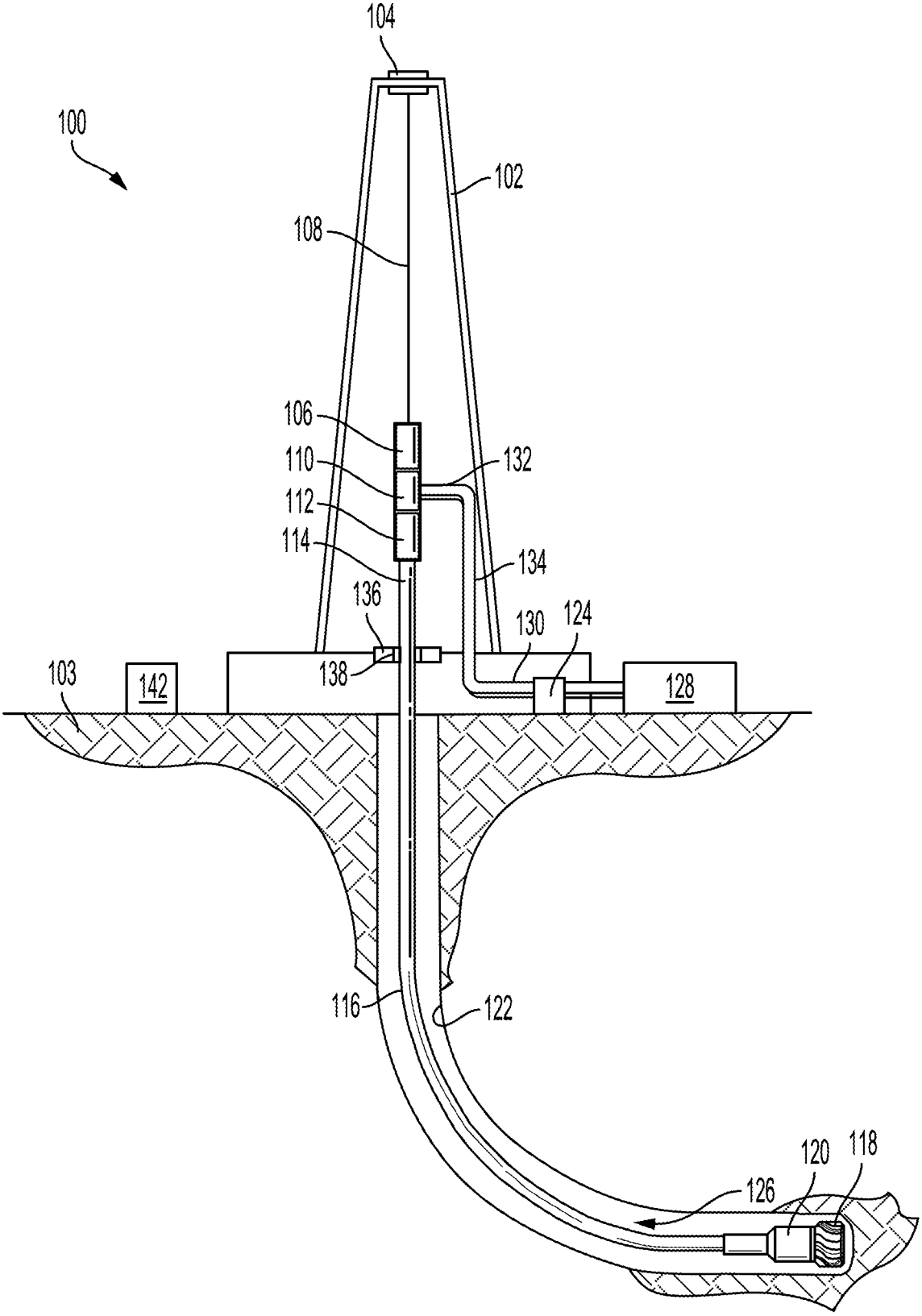
FIG. 1A illustrates one embodiment of a drilling system, in accordance with some embodiments of the present disclosure.

In the following description, details are set forth by way of example to facilitate discussion of the disclosed subject matter. It should be apparent to a person of ordinary skill in the field, however, that the disclosed embodiments are exemplary and not exhaustive of all possible embodiments.

Throughout this disclosure, a hyphenated form of a reference numeral refers to a specific instance of an element and the un-hyphenated form of the reference numeral refers to the element generically or collectively. Thus, as an example (not shown in the drawings), device "12-1" refers to an instance of a device class, which may be referred to collectively as devices "12" and any one of which may be referred to generically as a device "12". In the figures and the description, like numerals are intended to represent like elements.

A drilling system may include a derrick on the surface of the earth that is used to drill a borehole into the earth. A tubular (e.g., pipe or drill pipe) may be run down hole into and/or may be pulled out of a well. An iron roughneck may be used to connect and disconnect drill pipe during make-up (joining a piece of pipe to another or to a drillstring) and/or break-out (removing a piece of drill pipe from a drillstring or from another piece of drill pipe or a stand of drill pipe). The iron roughneck uses a rotary table and one or more torque wrenches/tongs and spinners to make up or break-out drill pipe. Iron roughnecks can clamp on the bottom (or lower) drill pipe with a torque wrench/tongs and thereby provide torque, while spinners (or a spinning or rotary wrench) turns the top (or upper) drill pipe. Typically, each section of drill pipe has a female end or female tool joint (with interior threads) and a male end or male tool joint (with outside threads). Pipe may be coupled together by rotating two drill pipes together via their female and male ends threaded engagement. Rotary slips may also be used to secure and hold onto a part of the drill pipe within the bowl of the drilling rig floor while the drill pipes are coupled together or de-coupled from one another.

Rotary slips may be mountable in a rotary table for gripping and releasing a drill pipe down hole into (i.e., during make-up) and/or being pulled out of a well (e.g., during breakout of a well). The rotary slips may secure and hold onto a part of the drill pipe while an additional pipe joint, pipe joints, stand of pipe, drill pipe(s), or other tubular is added to or removed from the drill pipe secured by the rotary slips.

Various embodiments of the present disclosure provide a method of use of an apparatus for lifting and setting rotary slips in a safe and efficient manner. In particular, one having ordinary skill in the art would appreciate that drill pipe, and components related thereto, are often relatively heavy and unwieldy to work with and manage. Accordingly, the safety of the operators in the field is at a heightened risk when moving and managing drill pipe or the like. Conventional rotary slip designs require a rig crew to place the rotary slips around the drill pipe themselves and position the rotary slips and drill pipe in the rotary table as a driller slowly lowers the drillstring. The apparatus and methods described herein addresses the need in the art for a safer method of placing and securing rotary slips to a drill pipe.

The apparatus for lifting and setting rotary slips described herein may include a movable base that slides toward and away from the drill pipe. The apparatus engages the rotary slips around the drill pipe when the apparatus is proximate to the drill pipe, thereby reducing the time that the rig crew is positioned relative to heavy equipment in various stages of being secured in place. Advantageously, the apparatus maintains the rotary slips relative to the drill pipe as additional drill pipe is added or as other operations are performed. When the drill pipe is ready to be lowered to its next position, the apparatus disengages the rotary slips from the drill pipe and moves the rotary slips away from the drill pipe and rotary table without the rig crew having to approach the rotary table. The apparatus according to at least some of the embodiments described herein provides a safe way for operators to remotely secure drill pipe in the rotary slips and remove the rotary slips from the rotary tablet compared to conventional methods.

According to embodiments of the present disclosure, the apparatus for lifting and setting rotary slips in a drilling rig may include a lifting arm, a cylinder, a linkage assembly, and movable or sliding base. The lifting arm may be coupled to the rotary slips via a linkage assembly. The linkage assembly may include a link arm and one or more extension guide springs. The linkage assembly may include a universal linkage adapter sized and shaped to couple with a variety of rotary slips brands, models, manufacturers, and/or sizes or a plurality of adapters sized and shaped to couple with different rotary slips brands, models, manufacturers, and/or sizes. The lifting arm may be pivotally mounted to the sliding base and to a cylinder, so that when the cylinder is actuated the rotary slips may be lifted and moved between a first position and a second position. The apparatus may incorporate a mechanical load-holding position to eliminate the risk of lost system pressure. The sliding base may be coupled to a cylinder actuated base plate so that when actuated, the sliding base, lifting arm, and rotary slips are retracted to a storage position (e.g., for drilling operations). The base plate may be set in the rotary table pin drive master bushings. The method of lifting and setting the rotary slips may be controlled through a controller or controller system such as a programmable logic controller (PLC). In some aspects, the lifting and setting of the rotary slips may be controlled utilizing solenoid actuated valves and an electronic input switch.

Referring to FIG. 1A, an embodiment of a drilling environment 100 is provided. Although the environment 100 is a drilling environment that is described with a top drive drilling system, it is understood that other embodiments may include other drilling systems, such as rotary table systems.

In the present example, the environment 100 includes a derrick 102 on a surface 103. The derrick 102 includes a crown block 104. A traveling block 106 is coupled to the crown block 104 via a drilling line 108. In a top drive system (as illustrated), a top drive 110 is coupled to the traveling block 106 and provides the rotational force needed for drilling. A saver sub 112 may sit between the top drive 110 and a drill pipe 114 that is part of a drillstring 116. The top drive 110 rotates the drillstring 116 via the saver sub 112, which in turn rotates a drill bit 118 of a BHA 120 in a borehole 122 in a formation. A mud pump 124 may direct a fluid mixture (e.g., mud) 126 from a mud pit or other container 128 into the borehole 122. The mud 126 may flow from the mud pump 124 into a discharge line 130 that is coupled to a rotary hose 132 by a standpipe 134. The rotary hose 132 is coupled to the top drive 110, which includes a passage for the mud 126 to flow into the drillstring 116 and the borehole 122. A rotary table 136 may be fitted with a master bushing 138 to hold the drillstring 116 when the drillstring is not rotating.

Some or all of a control system 142 may be located at the derrick 102, may be downhole, and/or may be remote from the actual drilling location. For example, the control system 142 may be a system such as is disclosed in U.S. Pat. No. 8,210,283 entitled System and Method for Surface Steerable Drilling, filed on Dec. 22, 2011, and issued on Jul. 3, 2012, which is hereby incorporated by reference in its entirety. Alternatively, the control system 142 may be a standalone system or may be incorporated into other systems at the derrick 102. The control system 142 may communicate via a wired and/or wireless connection (not shown).

Figure 1B:
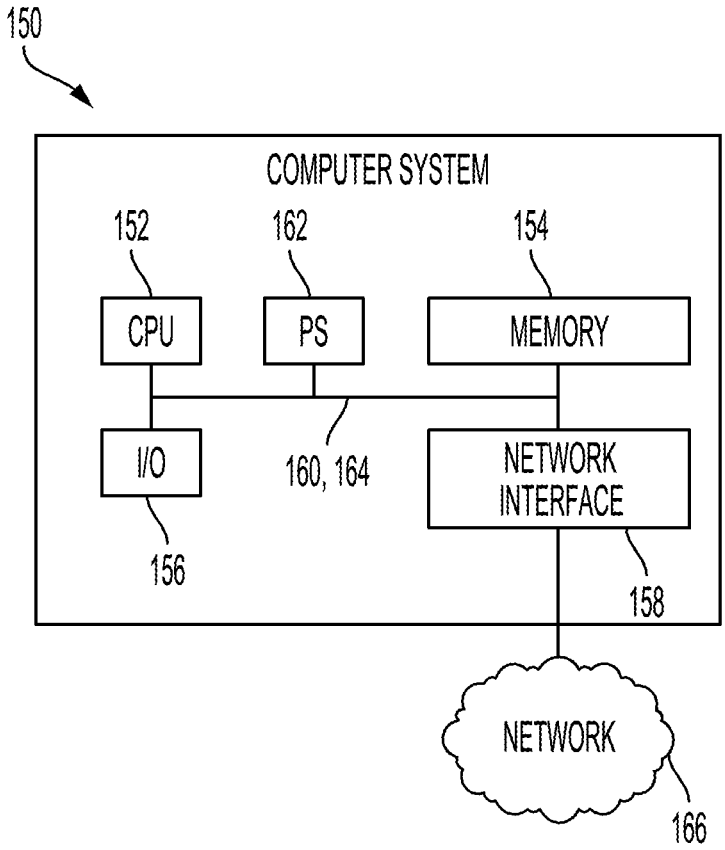
FIG. 1B illustrates one embodiment of a computer system or controller that may be used within the environment of FIG. 1A, in accordance with some embodiments of the present disclosure.

Referring to FIG. 1B, one embodiment of a computer system (or controller or control system) 150 is illustrated. The computer system 150 is one possible example of a system component or device such as the control system 142 of FIG. 1A or a separate system used to perform the various processes described herein, including but not limited to, the methods described herein with reference to FIGS. 5 and 6. In scenarios where the computer system 150 is on-site, such as within the environment 100 of FIG. 1A, the computer system may be contained in a relatively rugged, shock-resistant case that is hardened for industrial applications and harsh environments. It is understood that downhole electronics may be mounted in an adaptive suspension system that uses active dampening as described in various embodiments herein.

The computer system 150 may include a central processing unit ("CPU") 152, a memory unit 154, an input/output ("I/O") device 156, and a network interface 158. The components 152, 154, 156, and 158 are interconnected by a transport system (e.g., a bus) 160. A power supply (PS) 162 may provide power to components of the computer system 150 via a power transport system 164 (shown with data transport system 160, although the power and data transport systems may be separate).

It is understood that the computer system 150 may be differently configured and that each of the listed components may actually represent several different components. For example, the CPU 152 may actually represent a multiprocessor or a distributed processing system; the memory unit 154 may include different levels of cache memory, main memory, hard disks, and remote storage locations; the I/O device 156 may include monitors, keyboards, and the like; and the network interface 158 may include one or more network cards providing one or more wired and/or wireless connections to a network 166. Therefore, a wide range of flexibility is anticipated in the configuration of the computer system 150.

The computer system 150 may use any operating system (or multiple operating systems), including various versions of operating systems provided by Microsoft (such as WINDOWS), Apple (such as Mac OS X), UNIX, and LINUX, and may include operating systems specifically developed for handheld devices, personal computers, and servers depending on the use of the computer system 150. The operating system, as well as other instructions (e.g., software instructions for performing the functionality described in previous embodiments) may be stored in the memory unit 154 and executed by the processor 152. For example, the memory unit 154 may include instructions for performing the various methods and control functions disclosed herein.

The network 166 may be a single network or may represent multiple networks, including networks of different types. For example, the network 166 may include one or more cellular links, data packet networks such as the Internet, local area networks (LANs), and/or wide local area networks (WLAN), and/or Public Switched Telephone Networks (PSTNs). Accordingly, many different network types and configurations may be used to couple the computer system 150 to other components of the environment 100 of FIG. 1A and/or to other systems not shown (e.g., remote systems).

Figure 2:
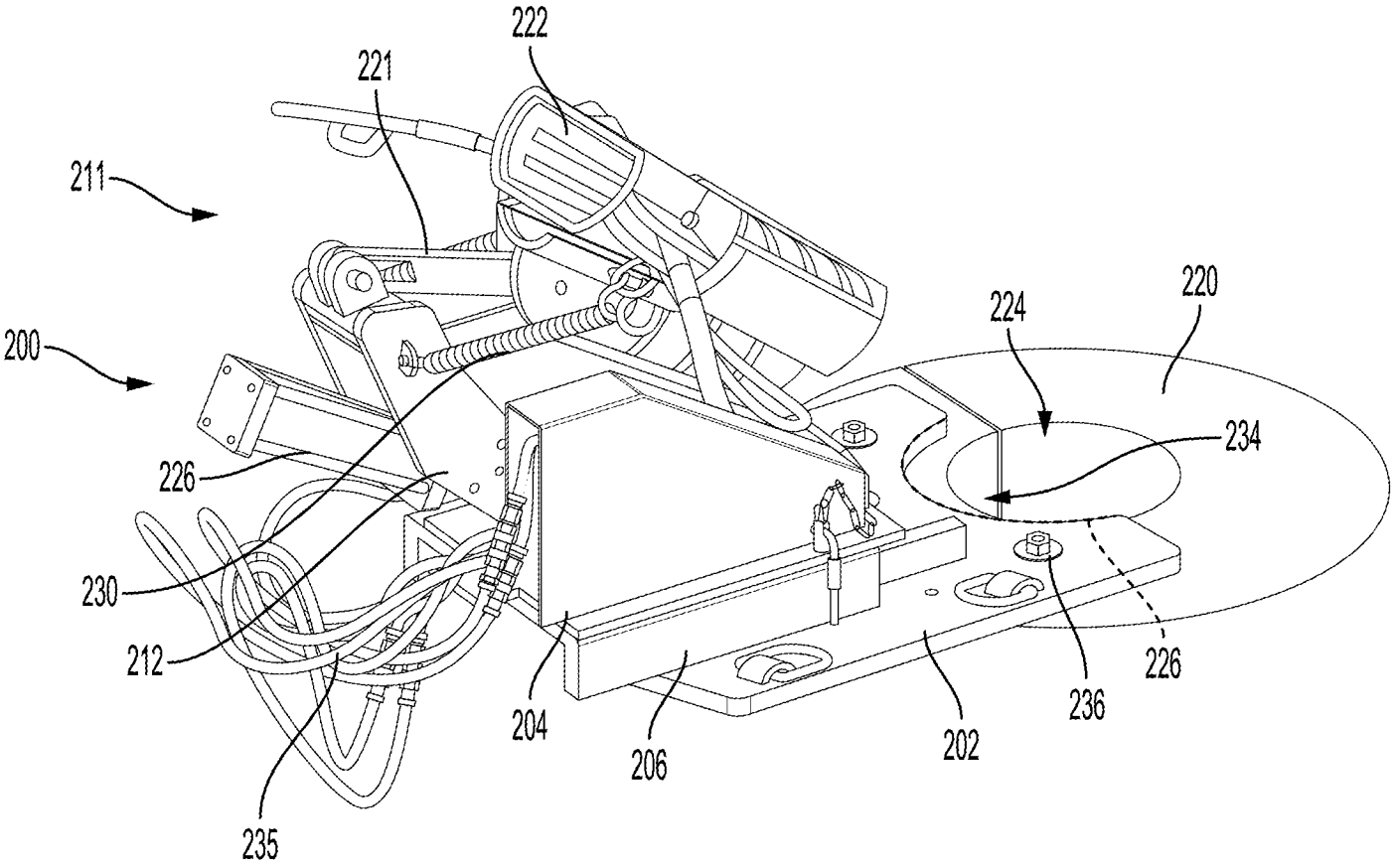
FIG. 2 illustrates an apparatus for moving tubular rotary slips, in accordance with some embodiments of the present disclosure.

FIG. 2 illustrates an apparatus 200 for moving tubular rotary slips positioned at a wellbore, according to embodiments of the present disclosure. The apparatus 200 includes the base plate 202 shown in FIG. 2 on the surface adjacent a rotary table 220 of a wellbore. In FIG. 2, the apparatus 200 is shown in a second (or retracted) position in which the rotary slips 222 are in an open position and positioned outside of the bowl 224 of the rotary table 220. In this retracted position, the rotary slips 222 are also positioned away from the front edge 234 of the base plate 202. This position may be interchangeably referred to as a stored position unless otherwise noted herein. The base plate 202 may include a front edge 234 having a curved cut out 226 that may be sized and shaped to surround some or all of the bowl 224 of the rotary table 220. The apparatus 200 may also include a sliding base 204, at least one cylinder 226, a base plate 202 having one or more tracks 206 for the sliding base 204 to slide along, a linkage assembly 211, and a lifting arm 212. The linkage assembly 211 may include a link arm 221 and one or more springs 230. According to at least some embodiments, the link arm 221 may be for use with rotary slips of a particular size, brand, or manufacturer and the pneumatic slip lifter link arm 240 may be used with slips of a different size, brand, or manufacturer. Accordingly, the apparatus 200 may be configured to be used with various rotary slips corresponding to one or more different brands, models, sizes, and/or types of rotary slips. In one particular embodiment, the pneumatic slip lifter link arm 240 may be used with either Den-Con or Vacro style rotary slips.

The position of the rotary slips 222 may be controlled by the position of the link arm 221 and the sliding base 204 and the position of the link arm 221 may be controlled by the position of the lifting arm 212. As further shown in FIG. 2, air supply lines 235 may couple at least the cylinder 226 (and/or an additional cylinder, not shown) to an air supply (not shown) for controlling actuation of the pneumatic cylinders (e.g., the cylinder 226 and/or the additional cylinder) for controlling the position of the sliding base 204 and the lifting arm 212. In some aspects, the cylinder 226 and/or the additional cylinder may be hydraulic cylinders coupled to a hydraulic fluid supplied via one or more hydraulic lines. As shown in FIG. 2, the base plate 202 may be secured to the rotary table 220 via one or more bushing pins 236 that may be positioned proximate the front edge 234 of the base plate 202.

With the base plate 202 secured to the rotary table 220, a tubular body or a joint of pipe may be positioned within the bowl 224 of the rotary table 220 (e.g., when running a drill pipe downhole). According to various embodiments of the present disclosure, a drill pipe may be formed of multiple joints of pipe that together define the drill pipe. In various embodiments, the apparatus 200 may be positioned adjacent the opening (e.g., the bowl 224) in the rotary table 220 after a joint of pipe has been positioned within the bowl 224 of the rotary table 220 (e.g., when tripping a drill pipe out of the wellbore). The apparatus 200 may be actuated to move the rotary slips 222 from the stored position (e.g., as shown in FIG. 2) to a secured or engaged position in which the rotary slips 222 surround the pipe and extend into the bowl 224 of the rotary table 220, as shown in FIG. 3.

To disengage the rotary slips from the pipe, the apparatus may again actuate the one or more cylinders to release the rotary slips from the pipe and retract the rotary slips from their engaged position within the bowl to the stored position without intervention of the rig crew. According to some embodiments of the present disclosure, the rotary slips may be retracted to a position that is different from the stored position. Again, the position of the rotary slips relative to the apparatus may be controlled by the position of the lifting arm and the sliding base of the apparatus, as well as the one or more springs. The position of the lifting arm and the sliding base of the apparatus may further be controlled by the one or more cylinders.

In various embodiments, the apparatus 200 as shown and described herein may be used to make up and/or break-out pipe from a drillstring. For example, the apparatus 200 may be used to connect tubulars via threaded connections incorporated at either end of the tubulars (or tools to be connected thereto). The apparatus 200 may be used to support the tubulars as they are torqued to the correct value to ensure a secure tool string without damaging the tubular bodies. In another example, the apparatus 200 may support tubulars during a process of unscrewing drillstring components, which are coupled by various threadforms (e.g., connections), including tool joints and other threaded connections.

Figure 3:
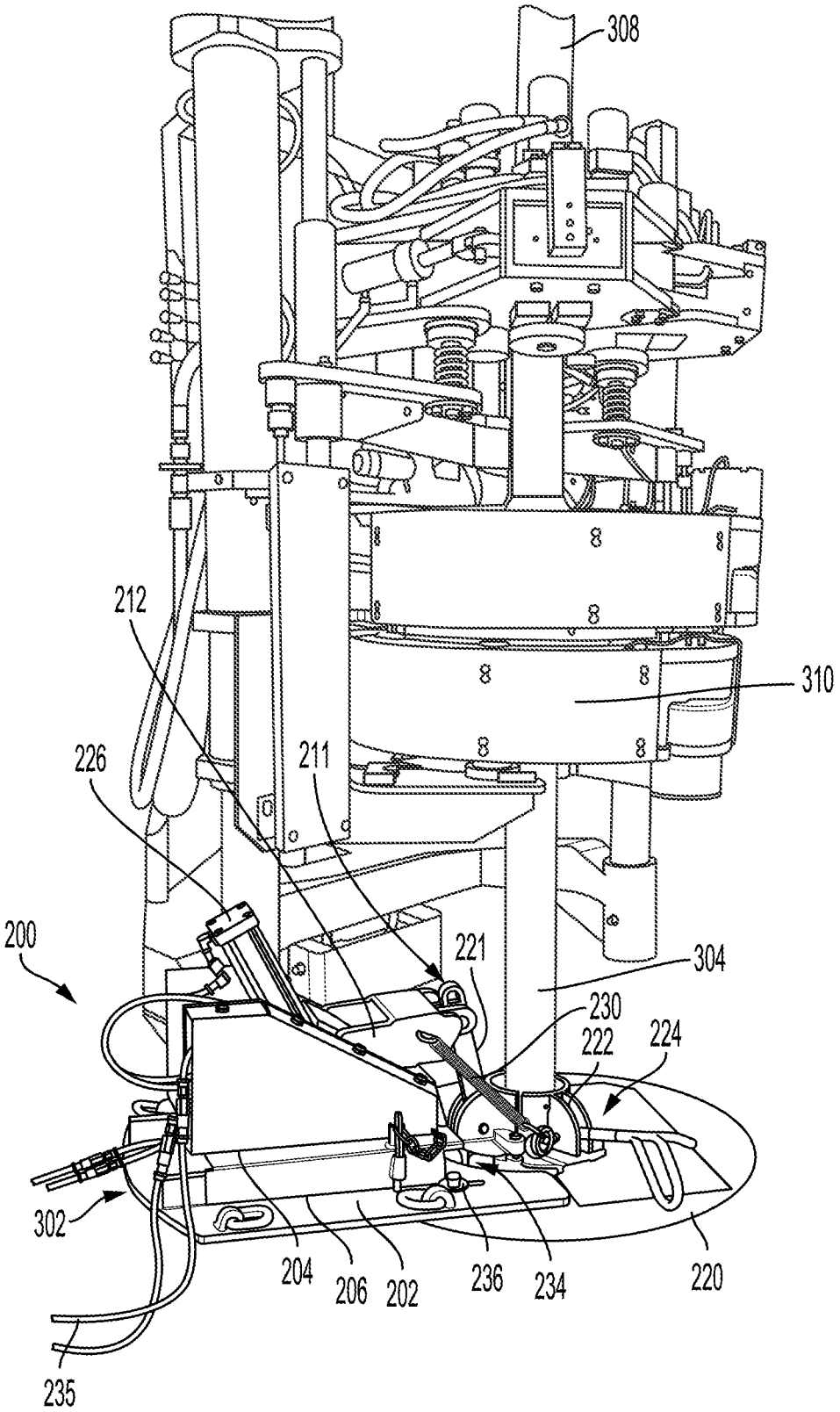
FIG. 3 illustrates the apparatus for moving tubular rotary slips in a secured or engaged position in which rotary slips surround a drill pipe and extend into the bowl of a rotary table, in accordance with some embodiments of the present disclosure.

FIG. 3 illustrates the apparatus 200 in a first (secured or engaged) position in which rotary slips surround a drill pipe and extend into the bowl of a rotary table. Description of apparatus 200 at least with respect to FIG. 2 is relevant to the description of the apparatus in the secured or engaged position in which rotary slips surround a drill pipe and extend into the bowl of a rotary table described herein. Accordingly, similarly labeled components have similar form and function unless otherwise noted herein. The position of the rotary slips 222 may be controlled via the position of the sliding base 204 and the lifting arm 212, as well as the one or more springs 230. The position of the sliding base 204 and the lifting arm 212 may be controlled by actuation of one or more cylinders, such as cylinder 226, as described above. For example, the sliding base 204 may be moved relative to the base plate 202 along the one or more tracks 206 by actuation of the cylinder 226 and/or an additional cylinder, not shown. Similarly, the position of the lifting arm 212 may be controlled by the cylinder 226 coupled thereto. The link arm 221 may be positioned relative to the lifting arm 212 via its coupling to the lifting arm 212 at the pivot point. The position of the rotary slips 222 may also be defined by the position of the sliding base 204 and the lifting arm 212. In addition, the position of the rotary slips 222 may also be affected by the one or more springs 230. For example, when the lifting arm 212 retracts to the stored position the one or more springs 230 may aid in moving the rotary slips 222 in a rearward direction towards the rear 302 of the base plate 202 to the stored position as shown in FIG. 2.

To actuate the rotary slips 222 from the stored position to the secured position, the sliding base 204 may be actuated by the cylinder 226 and/or an additional cylinder (not shown) to move towards the front edge 234 of the base plate 202 and the lifting arm 212 may be actuated via the cylinder 226 to move in a downward direction, toward the rotary table 220, with the link arm 221 rotating in a downward direction relative to the lifting arm 212. FIG. 3 depicts the apparatus 200 and the rotary slips 222 in the secured position. In this position, the rotary slips 222 at least partially surround the pipe 304. The rotary slips 222 may further engage the pipe 304 with one or more projections (not shown) on their respective curved faces. The rotary slips 222 may secure the pipe 304 in position for connecting an additional piece of pipe 308, and therefore may prevent the pipe 304 from moving relative to the rotary table 220 and the additional joint of pipe. For example, an additional piece of pipe 308 may be screwed onto to the pipe 304 secured by the rotary slips 222 by rotating the additional pipe 308 while the rotary slips 222 hold the initial pipe (e.g., pipe 304) in place. In some various embodiments, the additional pipe may be rotated via a machine such as a torque wrench or the like, to be described in further detail below.

In particular, FIG. 3 depicts an exemplary iron roughneck (interchangeably referred to as a torque wrench 306) including tongs 310 positioned about an upper portion of a piece of drill pipe 304 in an open position, according to aspects of the present disclosure. The open position may alternatively be referred to as a storage position or a first position as described herein. An exemplary torque wrench 306 is shown in FIG. 3 that may aid in retaining the lower pipe (e.g., pipe 304) in place while rotating the additional pipe 308 positioned above for joining the two lengths of pipes (e.g., pipe 304 and additional pipe 308) together. In some aspects more than one joint of pipe may be added to the drillstring at a time, such as when two or three previously coupled drill pipes (such as a stand) are added to the drillstring. In some embodiments of the present disclosure, the apparatus 200 may also be used during drilling of the wellbore such that the rotary slips 222 may permit the pipe 304 to rotate.

Figure 4A:
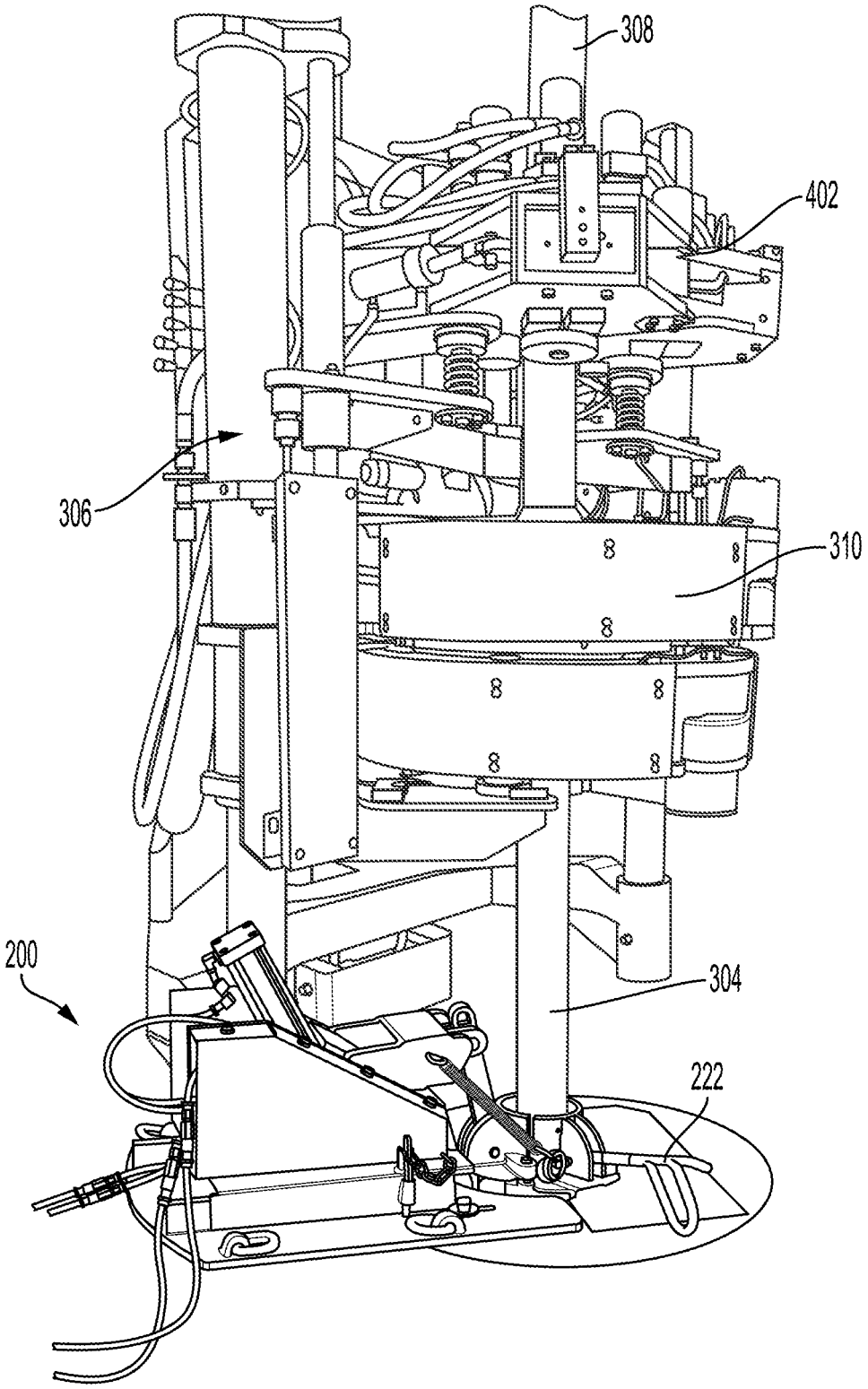
FIG. 4A is a view of an exemplary iron roughneck positioned around a drill pipe, including exemplary tongs and spinners along with an exemplary apparatus for moving tubular rotary slips, in accordance with some embodiments of the present disclosure.

FIG. 4A is a view of the exemplary iron roughneck 306 positioned around the drill pipe 304, including exemplary tongs 310 and spinners 410 along with an exemplary apparatus 200 for moving tubular rotary slips 222 as described in detail above. In particular, FIG. 4A illustrates the iron roughneck 306 in a closed position (or a secured position) for securing the drill pipe 304 to an additional piece of pipe 308. In the closed position, the tongs 310 grip drillstring components (e.g., the drill pipe 304 and/or the additional pipe 308) and applies torque thereto. The tongs 310 may include an opposing pair of tongs wherein one set of tongs may be tied off with a cable or chain to the derrick and the other pair of tongs is actively pulled with mechanical catheads. In one example, a pair of breakout tongs may be used as the active tongs during breakout (or loosening) operations and a pair of makeup tongs are active during makeup (or tightening) operations.

Figure 4B:
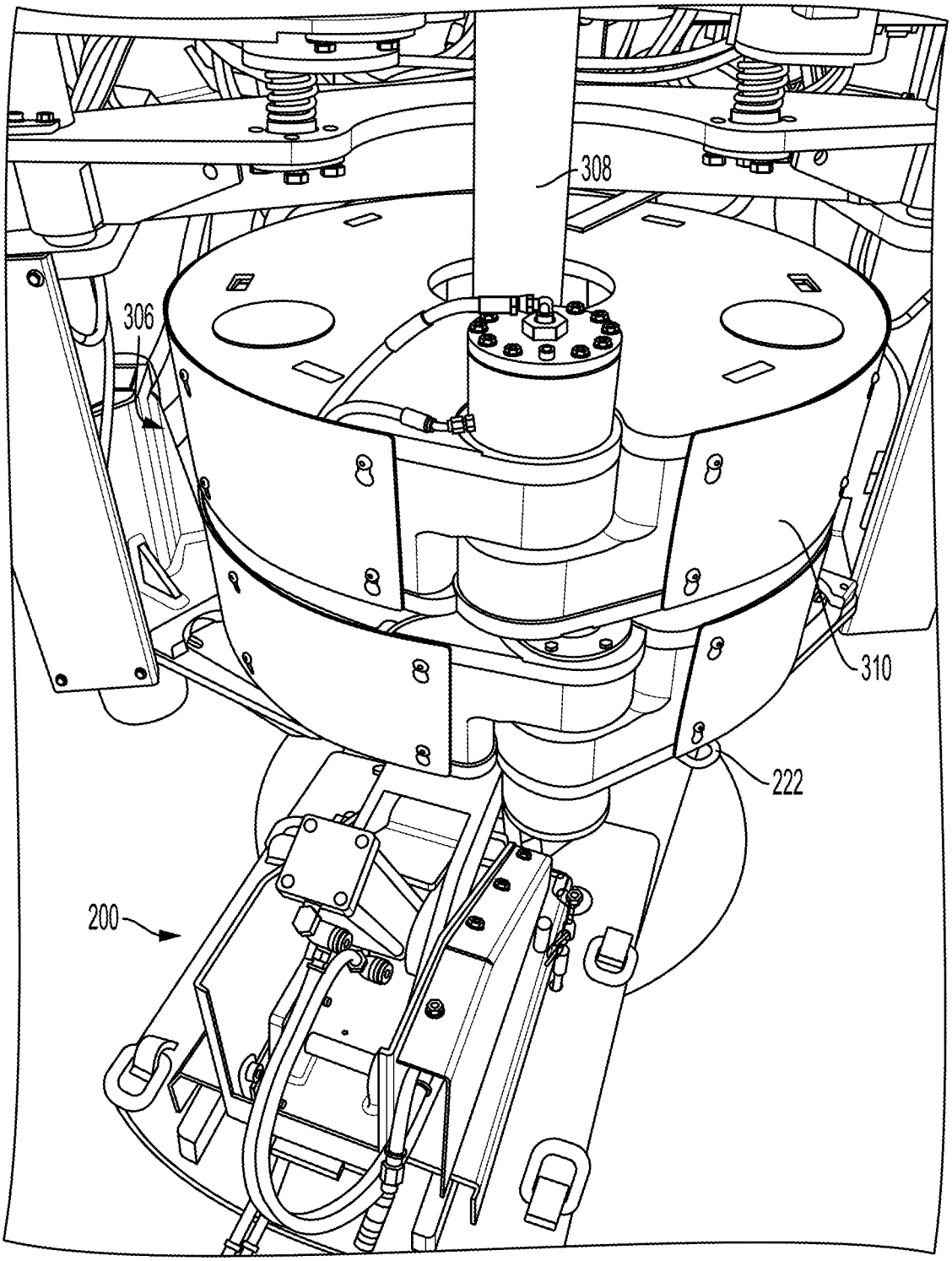
FIG. 4B is an enlarged view of the iron roughneck and the apparatus for moving tubular rotary slips, in accordance with some embodiments of the present disclosure.

One or more additional pieces of pipes may be secured to each other to form a drillstring using the iron roughneck 306 and the tongs 310. Spinners 402 may operate to rotate the additional pipe 308 to thread the additional pipe 308 to the drill pipe 304 or otherwise secure the additional pipe 308 to the drill pipe 304. For example, the spinners 402 may include mechanical device for rotating tubular members. FIG. 4B is an enlarged view of the iron roughneck 306 and the apparatus 200 for moving tubular rotary slips 222 in the secured or closed position. The secured or closed position may alternatively be referred to as a second position herein.

According to various embodiments described herein, the one or more cylinders (such as cylinder 226 and/or additional cylinder) may be controlled by a control system (not shown), such as the computer system 150. The control system may include a PLC. The control system may receive instructions from an operator via either a wired or wireless connection. In some aspects, the control system may receive instructions via a second control system (not shown). The control system may selectively move the sliding base, such as sliding base 204, and the lifting arm, such as lifting arm 212, in response to a command from an operator or a second control system to actuate the apparatus 200 and thereby the rotary slips 222 between at least a first position and a second position. For example, the rotary slips 222 may be lifted and lowered between at least a stored position and a use position. Apparatus 200 may perform methods for lifting tubular rotary slips as disclosed herein. For example, an exemplary apparatus 200 may actuate rotary slips 222 between a first position and a second position by actuating one or more cylinders that control the position of a sliding base 204 and a lifting arm 212. In addition, one or more springs 230 coupled between the rotary slips and the link arm coupled to the rotary slip may also aid in guiding the rotary slips into position within the bowl 224 of a rotary table 220. By using a linkage assembly 211 that may include a universal linkage adapter the apparatus 200 may be connected to multiple rotary slip brands, manufacturers, sizes, and/or models.

Figure 5:
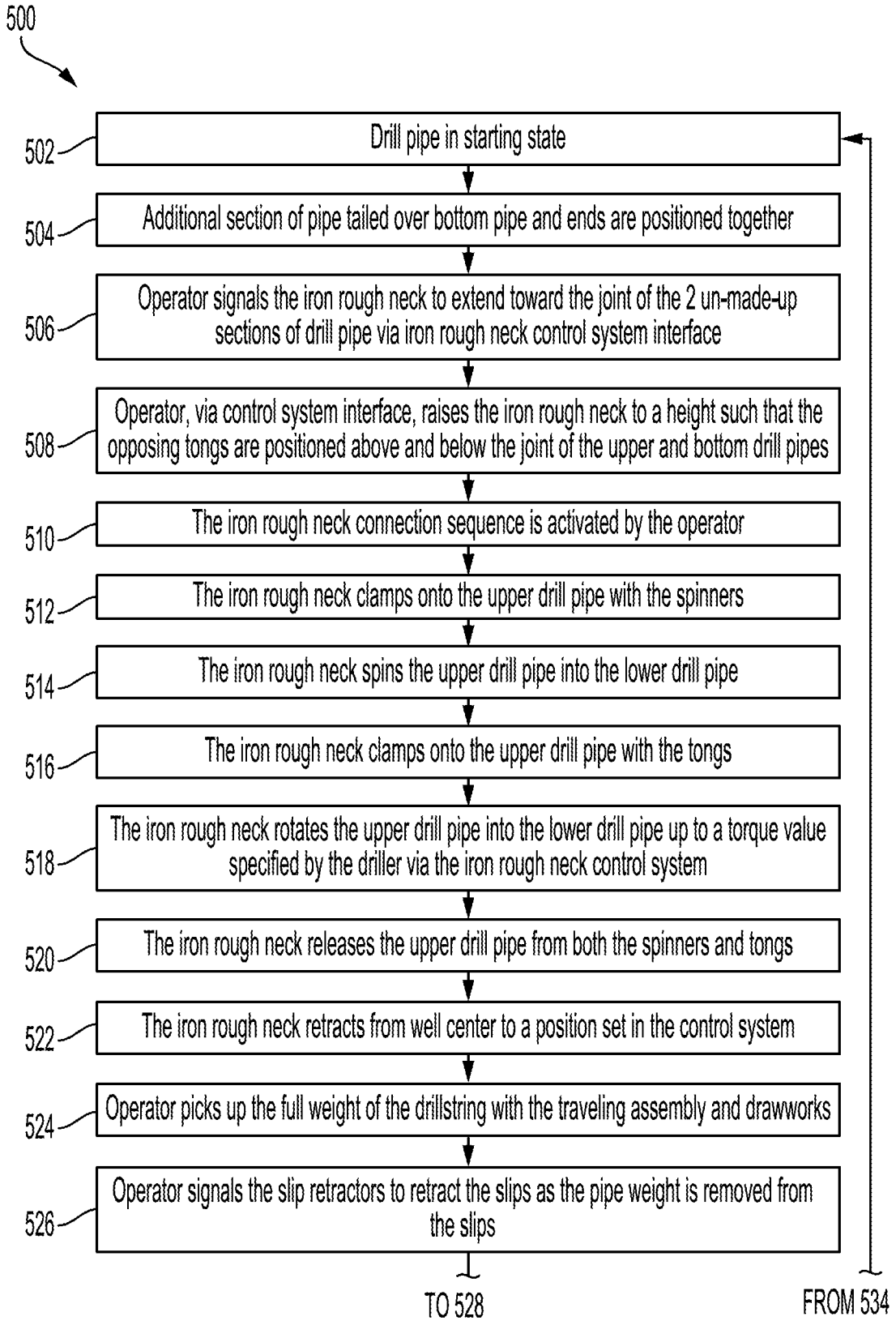
FIG. 5 is a flowchart of a method for connecting the drill pipe during a make-up, in accordance with some embodiments of the present disclosure.
Figure 5:
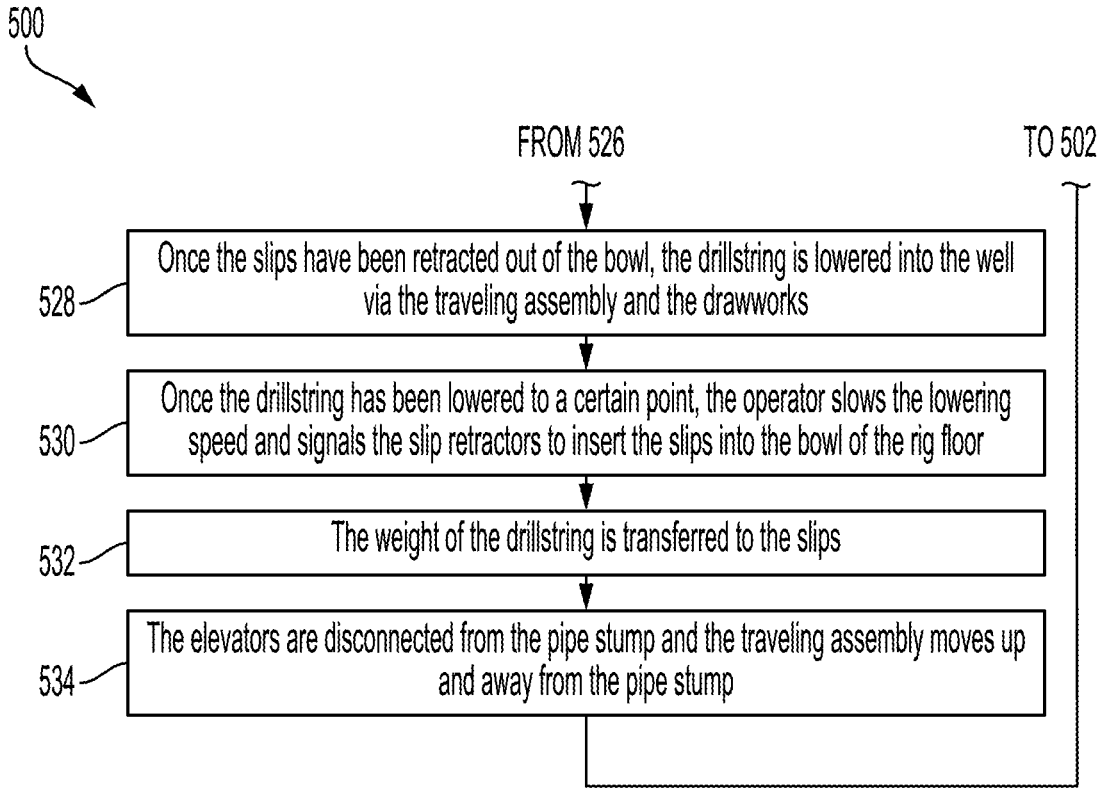

FIG. 5 depicts a flowchart of an exemplary, non-limiting, operation, or method 500 for connecting pipes or tubulars to form the drill pipe (make-up of the drill pipe). As shown in FIG. 5, the drill pipe may be provided in a starting state at step 502. In some embodiments, in the starting state, a length of drill pipe (also referred to herein as a bottom pipe, a lower section, or a first piece of pipe) may be positioned within rotary slips by an apparatus for lifting and setting tubular rotary slip, such as apparatus 200 as described in detail above and shown at least in FIGS. 2 and 3. The rotary slips may be set in place with the bottom pipe in position in the rotary table. In the starting state at step 502, the iron roughneck may be retracted away from the wellbore and the bottom pipe has been disconnected from anything above the joint directly above the rotary slips. Furthermore, any elevators may be disconnected from and clear of the end of the bottom pipe (e.g., the pipe stump). For example, elevators may include a hinged mechanism that may be closed around the bottom pipe prior to step 502 to facilitate lowering the bottom pipe into the wellbore or lifting a pipe out of the wellbore. In the closed position, the elevators arms may be latched together to form a load-bearing ring around the pipe in the rotary table, and, in the open position, the elevator arms may be split into multiple components (such as two halves) and moved away from the pipe before proceeding with step 504.

At step 504, an additional section of drill pipe (e.g., a second piece of pipe or upper drill pipe) may be positioned or tailed over to the bottom pipe that is secured by the rotary slips. A male end of the additional section of drill pipe may be inserted into a female end of the bottom pipe. In other embodiments, the additional section of drill pipe is positioned or tailed over to the bottom pipe and a female end of the additional drill pipe may receive a male end of the bottom pipe. Other threading mechanisms may be used at step 504 to initiate securing the first piece of pipe to the second piece of pipe.

At step 506 the operator signals the iron roughneck to extend towards the joint of the bottom pipe and second piece of pipe which are yet un-made-up sections of drill pipe. In some embodiments, the iron rough neck may be controlled by the operator via an iron roughneck control system interface, which may include a computer system such as system 150. The signal may include an electronic communication via a button, lever, wheel, or the like. In various embodiments, one or more steps of method 500, such as step 506 may be automatically performed, in whole or in part, as controlled by a control system (e.g., computer system 150) electronically coupled to the iron roughneck control system interface.

At step 508 the operator, via a control system interface, which may be the same or in addition to the iron roughneck control system interface described with respect to step 506, may raise the iron roughneck to a height such that opposing tongs are positioned above and below the location where the two pieces of pipe adjoin one another. For example, the operator may operate the tongs to form an open position, such as that shown in FIG. 3 and described above.

At step 510, the iron roughneck connection sequence may be activated by the operator using the control system interface. Again, one or more operations of step 510 may be performed automatically. For example, the iron roughneck connection sequence may be automatically activated in response to one or more sensors detecting that the iron roughneck and/or the opposing tongs are in the correct orientation and/or height.

At step 512, the iron roughneck may clamp onto or otherwise secure the upper drill pipe with the spinners. At step 514. the iron roughneck spins the upper drill pipe into the bottom drill pipe. For example, the upper drill pipe may include corresponding threads to the bottom drill pipe such that the upper drill pipe is thread into the bottom drill pipe.

At step 516, the iron roughneck may clamp onto the upper drill pipe with an opposing pair of tongs, such as tongs 310 described in detail above and as shown at least in FIGS. 4A-4B. With the iron roughneck clamped onto the upper drill pipe, at step 518, the iron roughneck rotates the upper drill pipe into the bottom pipe up to a torque value specified by the operator via the iron roughneck control system. In response to reaching the torque value specified by the operator, at step 520 the iron roughneck may release the pipe from both the spinners and the tongs. Accordingly, at step 522 the iron roughneck may be retracted from the well center to a second position, such as a storage position, which may be set by a user input to the control system.

At step 524, the operator may use a control system interface to direct a drawworks to lift the full weight of the drillstring, which now includes the upper and bottom pipes, with the traveling assembly. Subsequently, at step 526, the operator signals the slip retractors (e.g., the apparatus for lifting and setting tubular rotary slips such as apparatus 200 described in detail above) to retract the rotary slips as the pipe weight is removed from the rotary slips. With the rotary slips retracted out of the bowl of the rig floor, the drillstring is lowered into the well via the traveling assembly and drawworks at step 528. At step 530, with the drillstring lowered to a certain point, the operator may slow the lowering speed and signal the slip retractors (e.g., apparatus 200) to insert the rotary slips into the bowl of the rig floor. At step 532, the weight of the drillstring may be transferred to the rotary slips via the rotary slips engagement with the upper pipe, which has been moved into position as a bottom pipe. At step 534, the elevators may be disconnected from the pipe stump and the traveling assembly moves up and away from the pipe stump defined by the end of the upper pipe (now in the bottom pipe position) extending from the rotary table.

Method 500 may return to step 502 to add an additional section of pipe to the drillstring following the sequence described herein by adding the additional section of pipe to the upper pipe (which is currently in position as a bottom pipe).

It should be noted that, in each case above where the operator, driller, derrickman, or other individuals performing any roles on a drilling rig, may take action, an automated control system coupled to the slips and iron roughneck may be used to automatically initiate and control the one or more of the operations described herein.

Figure 6:
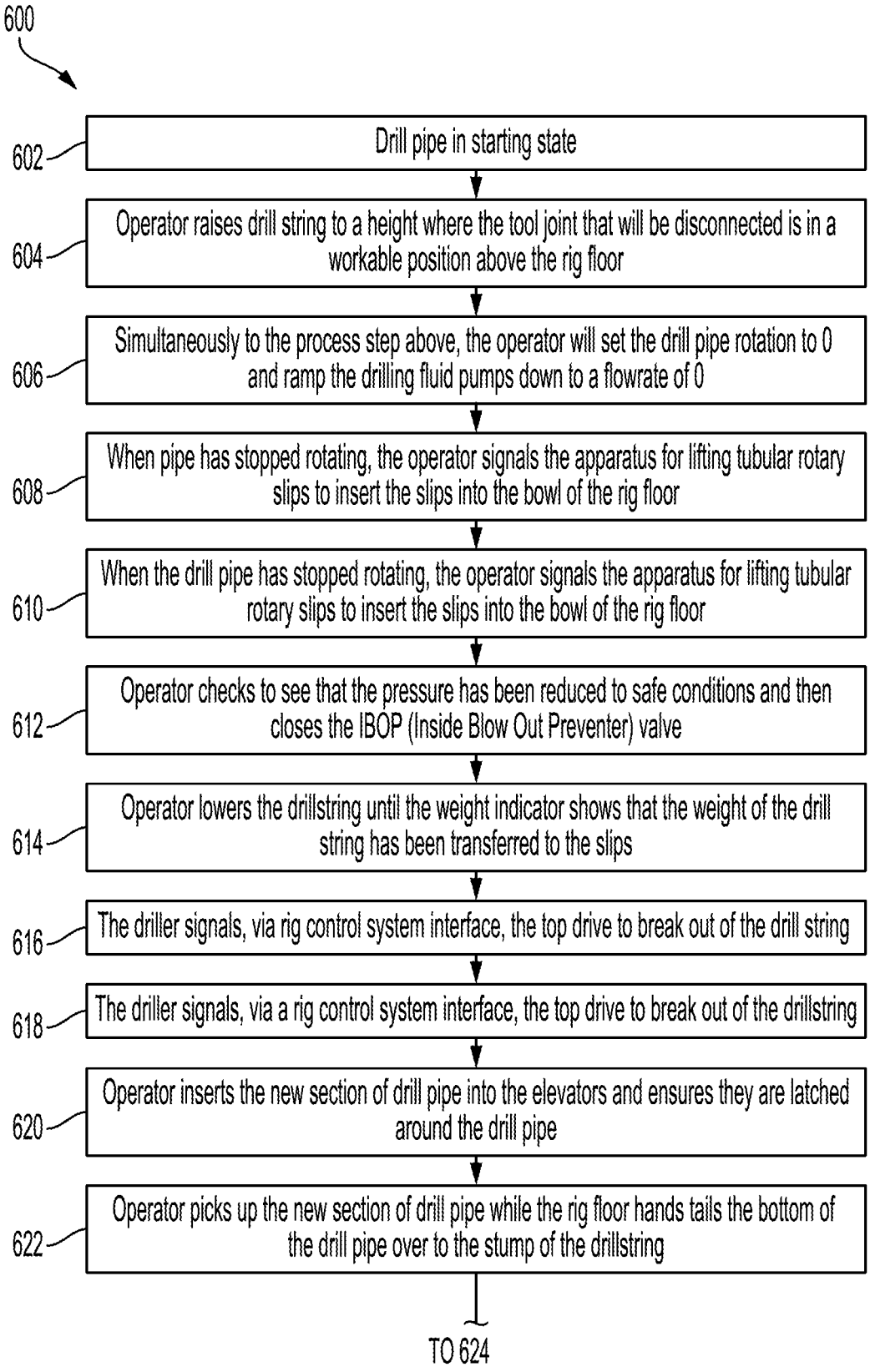
FIG. 6 is a flowchart of a method for drilling a well, in accordance with some embodiments of the present disclosure.
Figure 6:
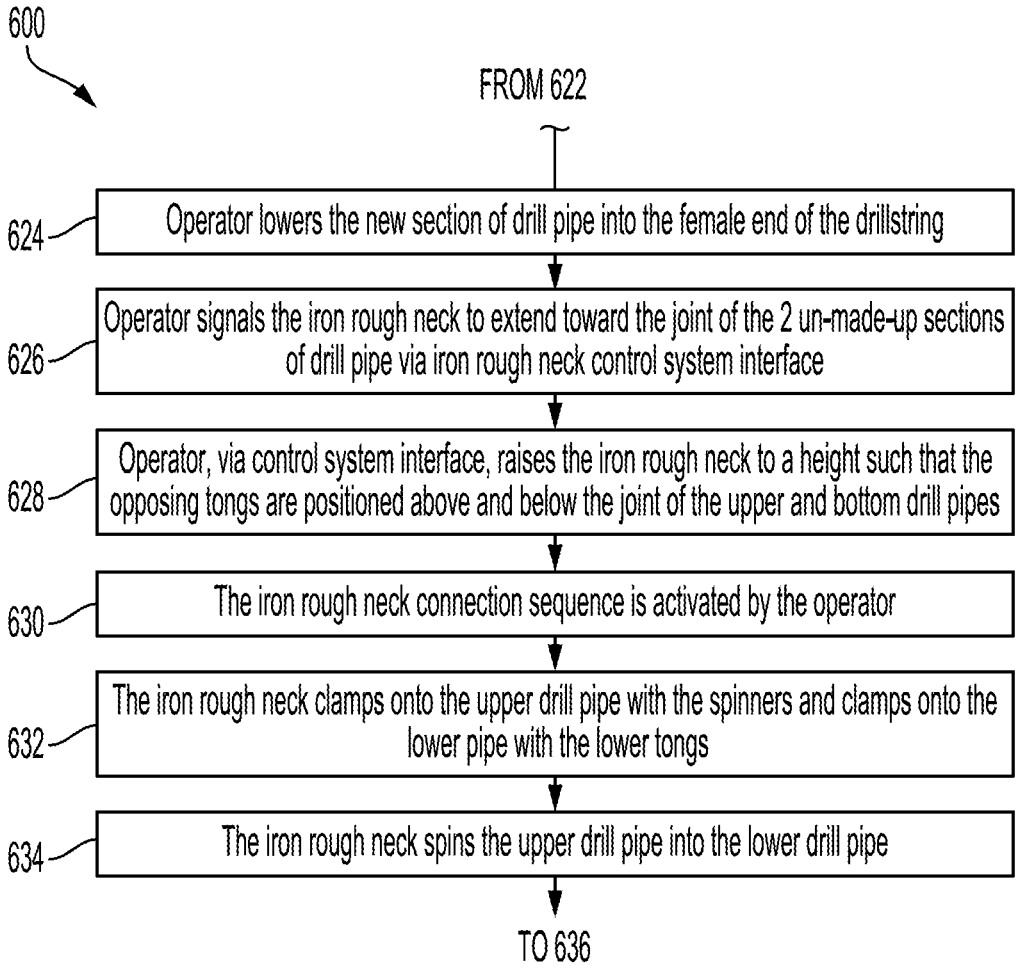
Figure 6:
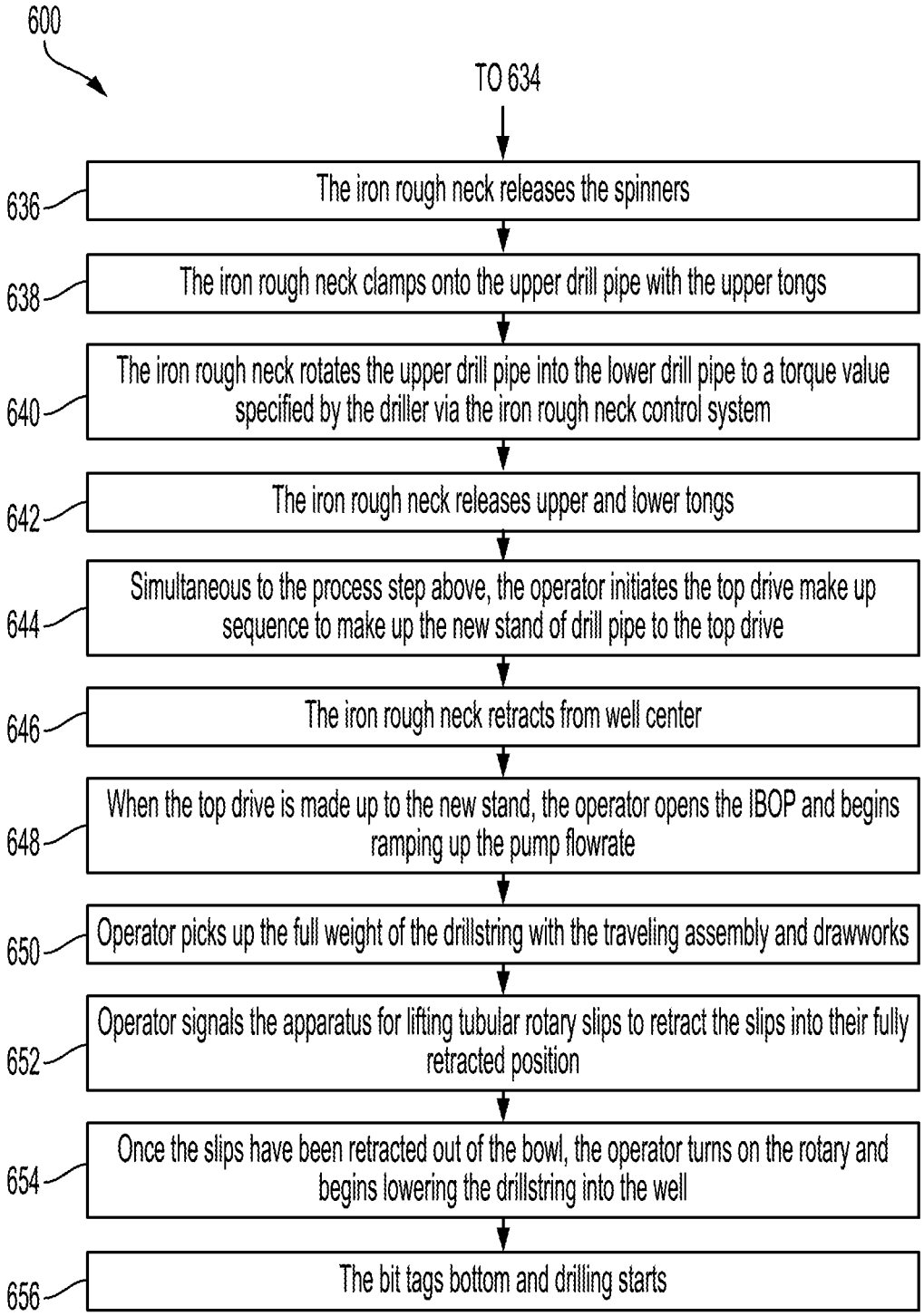

FIG. 6 depicts a flowchart of an exemplary, non-limiting, operation, or method 600 of drilling of the well. As shown in FIG. 6, in the starting state at step 602 rotary slips, such as rotary slips 222 described above, may be retracted out of the bowl of the rig floor such that the center of gravity of the rotary slips shifts to a point where gravity will not pull the rotary slips into the bowl. The rotary slips may be retracted using an apparatus, such as apparatus 200 described in detail above. Furthermore, an iron roughneck may be retracted into its home or storage position. A drill pipe may be coupled to a top drive via a threaded engagement and the elevators may be disconnected from and clear of the pipe stump of the drillstring.

At step 604, the operator may signal using a control system interface to raise the drillstring to a height where the tool joint defined by an upper pipe and a bottom pipe to be disconnected is in a workable position above the rig floor. Step 606 may be performed simultaneously to step 604 in at least some embodiments. At step 606, the operator may set the drill pipe rotation to a 0 and ramp the drilling fluid pumps to a flowrate of 0.

At step 608, when the pipe has stopped rotating, the operator may signal the apparatus to insert the rotary slips into the bowl of the rig floor. Step 610 may be performed simultaneously with step 608 in at least some embodiments. At step 610, the bleed off valve of the drilling fluid supply line may be opened to bleed off any pressure remaining in the line and the bleed off valve may be reclosed. At step 612, the operator may check to see that the pressure has been reduced to safe conditions. In response to determining that the pressure has been sufficiently reduced, the operator may close an integrated blow out preventor (IBOP) valve.

At step 614, the operator may lower the drillstring until the weight indicator shows that the weight of the drillstring has been transferred to the rotary slips. At step 616, the operator may signal, via a rig control system interface, the top drive to break-out of the drillstring. At step 618, once the top drive is decoupled from the drillstring, the operator raises the traveling assembly in a vertical direction to receive another section of drill pipe. The operator, at step 620, may insert the new section of drill pipe into the elevators and ensure that the elevators are latched around the drill pipe. At step 622, the operator may pick up the new section of drill pipe while the rig floor hand tails the bottom of the drill pipe over to the stump of drillstring. At step 624, the operator may lower the new section of drill pipe into the female end of the exposed pipe stump of the drillstring. At step 626, the operator may signal the iron roughneck to extend towards the joint of the 2 un-made-up sections of drill pipe via an iron roughneck control system interface. At step 628, via the control system interface, the operator may raise the iron roughneck to a height such that the opposing tongs are positioned above and below the joint of the upper and lower pipe sections. The operator, at step 630, may activate the iron roughneck connection sequence. In response to the iron roughneck connection sequence being activated, at step 632, the iron roughneck may clamp onto the upper drill pipe with the spinners and may clamp onto the lower pipe with the lower tongs such that, at step 634, the iron roughneck may spin the upper section of drill pipe into the lower section of drill pipe.

At step 636, the roughneck releases the spinners from the upper drill pipe. Then, at step 638, the operator may signal the iron roughneck to clamp onto the upper drill pipe with the upper tongs. The iron roughneck, at step 640, rotates the upper pipe section into the lower pipe section, via the upper and lower tongs, up to a torque value specified by the operator via the iron roughneck control system. At step 642, the iron roughneck releases the pipe from both the spinners and upper and lower tongs. Step 644 may be performed simultaneously with step 642 in at least some embodiments where the operator may initiate the top drive make up sequence to make up the new stand of drill pipe to the top drive. Accordingly, at step 646, the iron roughneck may be retracted from the well center. At step 648, when the top drive is made up to the new stand, the operator may open the IBOP and begin ramping up the pump flowrate. At step 650, the operator may pick up all of the weight of the drillstring with the traveling assembly and drawworks. At step 652, the operator may then signal the apparatus to retract the rotary slips to a fully retracted or storage position in which the center of gravity of the rotary slips has shifted to a point where gravity will not pull the rotary slips into the bowl. With the rotary slips fully retracted out of the bowl, at step 654, the operator may turn on the rotary table and begins lowering the drillstring into the well. At step 656, the bit may tag the bottom and start the drilling process.

As noted above with respect to the method 500, in method 600 described above, some or all of the steps performed by the operator, driller, derrickman, or other individuals performing any roles performed on a drilling rig, can be automated and can be initiated and controlled by a control system (e.g. control system 150) coupled to the rotary slips and/or roughneck. In addition, one or more of the steps described with respect to FIG. 5 and/or FIG. 6 may be initiated, performed, or completed simultaneously (in whole or in part) with other steps of the disclosed operations. In other words, one or more steps of the operations described herein may partially or fully overlap with one another.

In some aspects of the present disclosure, more or fewer steps may be performed from the exemplary methods and operations described above. For example, although the discussion above has been primarily focused on making-up and breaking-out drill pipe, many of the disclosed steps and same equipment may be used for making-up or breaking-out a casing. In addition, the methods and operations described herein may also be performed in reverse for breaking-out a drill pipe or casing.

The subject matter of embodiments of this patent is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

It should be noted that references to a "stand" or a single "piece" of pipe should be understood to include both situations with respect to the methods and apparatus described herein. The references to a piece of pipe or to a stand are intended to be illustrative examples and not limiting.

Different arrangements of the components depicted in the drawings or described above, as well as components and steps not shown or described, are possible. Similarly, some features and subcombinations are useful and may be employed without reference to other features and subcombinations. Embodiments of the disclosure have been described for illustrative and not restrictive purposes, and alternative embodiments will become apparent to readers of this patent. Accordingly, the present disclosure is not limited to the embodiments described above or depicted in the drawings, and various embodiments and modifications can be made without departing from the scope of the claims below.

We claim:

1. A method for connecting drill pipe to a drillstring in a wellbore comprising:

actuating a movable base of a rotary slips moving apparatus from a first position in which the movable base is positioned laterally away from a bowl in a rig floor, to a second position in which the movable base is positioned more proximate to the bowl of the rig floor;

actuating a lifting arm of the rotary slips moving apparatus from a first arm position, in which a rotary slips coupled to the rotary slips moving apparatus are positioned outside of the bowl of the rig floor, to a second arm position, in which at least a portion of the rotary slips extend within the bowl of the rig floor;

positioning a lower section of drill pipe within the rotary slips coupled to the rotary slips moving apparatus;

setting the rotary slips;

positioning an upper section of drill pipe over the lower section of drill pipe;

signaling, by an iron roughneck control system, an iron roughneck to extend toward a joint of the lower section of drill pipe and upper section of drill pipe;

raising, via a control system interface, the iron roughneck to a height such that opposing tongs are positioned above and below the joint between the upper section of drill pipe and the lower section of drill pipe;

clamping onto the lower section of drill pipe with the tongs of the iron roughneck;

clamping onto the upper section of drill pipe with spinners of the iron roughneck;

spinning the upper section of drill pipe into the lower section of drill pipe via the spinner;

spinning the upper section of drill pipe into the lower section of drill pipe up to a predetermined torque value;

in response to reaching the predetermined torque value, releasing, by the iron roughneck, the upper section of drill pipe and the lower section of drill pipe from the spinners and the opposing tongs;

retracting the iron roughneck from a first position proximate a well center to a second position set by the iron roughneck control system;

picking up a drillstring including the upper section of drill pipe and the lower section of drill pipe;

retracting the rotary slips from the lower section of the drill pipe of the drill string by actuating the lifting arm of the rotary slips moving apparatus from the second arm position to the first arm position and actuating the movable base of a rotary slips moving apparatus from the second position to the first position;

lowering the lower section of drillstring and a portion of the upper section of drillstring into the wellbore;

reducing the lowering speed of the drillstring;

actuating the movable base of a rotary slips moving apparatus from a first position to the second position;

actuating the lifting arm of the rotary slips moving apparatus from the first arm position to the second arm position; and transferring the drillstring to the rotary slips.

2. The method of claim 1, further comprising:

connecting elevators to the drillstring prior to lowering the drillstring into the wellbore; and moving a traveling assembly coupled to the elevators toward the drillstring.

3. The method of claim 2, further comprising:

disconnecting the elevators from the drillstring after lowering the drillstring into the wellbore; and moving the traveling assembly up and away from the drillstring.

4. The method of claim 2, wherein the picking up the drillstring including the upper section of drill pipe and the lower section of drill pipe further comprises picking up the drillstring including the upper section of drill pipe and the lower section of drill pipe with the traveling assembly and a drawworks.

5. The method of claim 1, wherein the picking up the drillstring including the upper section of drill pipe and the lower section of drill pipe includes picking up a full weight of the drillstring.

6. The method of claim 5, wherein the full weight of the drillstring is transferred to the rotary slips.

7. The method of claim 1, a male end of the upper section of drill pipe is positioned over and spun into a female end of the lower section of drill pipe.

8. The method according to claim 1, wherein the step of actuating the movable base of a rotary slips moving apparatus between the first position and the second position further comprising actuating the movable base longitudinally along one or more tracks between the first position and the second position.

9. A method for drilling a wellbore comprising:

providing, by a rotary slips moving apparatus, a rotary slips in a retracted position out of a bowl of a rig floor;

providing an iron roughneck in a retracted position away from a drillstring extending into a wellbore;

providing the drillstring coupled to a top drive via a threaded connection;

providing an elevator disconnected from an end of the drillstring;

raising the drillstring to a height such that a tool joint between a first pipe and a second pipe of the drillstring is in a workable position above the rig floor;

setting a drillstring rotation to 0 and ramp corresponding drilling fluid pumps to a flowrate of 0;

in response to the drillstring stopping rotation, signaling the rotary slips moving apparatus to insert the rotary slips into the bowl in the rig floor;

in response to the signal, actuating a movable base of the rotary slips moving apparatus and a lifting arm of the apparatus from a stored position corresponding to the movable base being positioned away from an edge of the bowl and the rotary slips being positioned outside of the bowl, to a secured position in which the movable base is proximate to the edge of the bowl and the rotary slips extend within the bowl;

lowering the drillstring until a weight of the drillstring is transferred to the rotary slips;

signaling, via a rig control system interface, a top drive to break-out of the drillstring;

in response to the top drive decoupling from the drillstring, raising a traveling assembly up to receive an additional section of drill pipe;

latching elevators around the additional section of drill pipe;

positioning a bottom end of the additional section of drill pipe over the drillstring;

lowering the additional section of drill pipe to contact a stump of the drillstring;

positioning the iron roughneck, in response to a signal from an iron roughneck control system interface, proximate to a joint between the additional section of drill pipe and the stump of the drillstring;

positioning a first pair of tongs above the joint and a second pair of tongs below the joint;

clamping, by spinners of the iron roughneck, onto the additional section of drill pipe;

spinning, by the spinners of the iron roughneck, the additional section of drill pipe such that the additional section of drill pipe threads onto the stump of the drillstring such that the additional section of drill pipe and the drillstring couple together and an end of the additional section of drill pipe then defines the stump of the drillstring;

ceasing, by the spinners of the iron roughneck, spinning the additional section of drill pipe in response to reaching a predetermined torque value;

releasing, by the spinners and the tongs of the iron roughneck, the additional section of drill pipe and the drill pipe previously defining the stump;

initiating a top drive makeup sequence to makeup the additional section of drill pipe to the top drive;

retracting the iron roughneck from the wellbore;

picking up the drillstring with the traveling assembly and drawworks;

signaling the rotary slips moving apparatus to retract the rotary slips to a fully retracted position in which the rotary slips are retracted from the bowl by actuating the movable base of the rotary slips moving apparatus and the lifting arm of the apparatus from the secured position in which the movable base is proximate to the edge of the bowl and the rotary slips extend within the bowl to the stored position corresponding to the movable base being positioned away from an edge of the bowl and the rotary slips being positioned outside of the bowl; and with the rotary slips retracted from the bowl, turning on a rotary table and lowering the drillstring into the wellbore.

10. The method of claim 9, further comprising prior to lowering the drillstring, opening a bleed off valve of a drilling fluid supply line to bleed off any pressure remaining in the drilling fluid supply line;

closing the bleed off valve; and closing an integrated blow out preventor (IBOP) valve.

11. The method of claim 10, in response to the top drive being made-up to the additional section of drill pipe, closing the IBOP valve and increasing a pump flow rate.

12. The method of claim 9, wherein lowering the additional section of drill pipe to contact the stump of the drillstring includes that a male end of the additional section of drill pipe extending into a female end of a drill pipe defining the stump of the drillstring.

13. The method according to claim 9, wherein the step of actuating the movable base of the rotary slips moving apparatus and the lifting arm of the apparatus from the stored position to the secured position further comprising sliding the movable base longitudinally along one or more tracks between the first position and the second position.

14. A method of disconnecting pipe, the method comprising:

positioning a drillstring so that a portion of a pipe extends upwardly from a drilling rig floor and a pipe joint is positioned proximal to an iron roughneck;

ceasing rotation of the drillstring;

inserting a rotary slips into a bowl of the rig floor by actuating an apparatus for moving rotary slips between a stored position in which a movable base is positioned away from an edge of the bowl and a secured position in which the movable base is positioned proximate to the edge of the bowl, wherein the movable base is actuated along one or more tracks;

transferring weight of the drillstring to the rotary slips;

extending the iron roughneck toward the drillstring;

adjusting a height of the iron roughneck so that upper and lower tongs of the iron roughneck are located above and below, respectively, the pipe joint;

clamping the lower tongs of the iron roughneck onto the drillstring below the pipe joint;

clamping spinners of the iron roughneck onto the drillstring above the pipe joint;

spinning a section of pipe forming the drillstring above the pipe joint relative to the remaining drillstring below the pipe joint by the iron roughneck to thereby unscrew the section of pipe from the drillstring;

disengaging the iron roughneck from the section of pipe and the drillstring; and moving the section of pipe to a storage location.

15. The method of claim 14, wherein some or all of the steps are performed automatically by a control system.

16. The method according to claim 14, wherein some or all of the steps are repeated a plurality of times for a plurality of pieces of pipe.

17. The method according to claim 14, wherein inserting the rotary slips into the bowl of the rig floor is performed by an apparatus for moving rotary slips, the apparatus for moving rotary slips further comprising further comprises:

a movable base adapted to move between a first position and a second position, wherein the first position is closer to the bowl in the rig floor than the second position; and actuating a lifting arm of the apparatus for moving rotary slips from having a first end and a second end, wherein the second end is pivotally coupled to the movable base, and wherein the lifting arm has a first arm position to a second arm position, wherein the lifting arm has a first end pivotally coupled to the movable base.

* * * * *